US006880190B2

(12) United States Patent
Danino Inchaustegui

(10) Patent No.: US 6,880,190 B2
(45) Date of Patent: Apr. 19, 2005

(54) CONTROLLED PRESSURE AND FLOTATION SYSTEM

(76) Inventor: Rafael Danino Inchaustegui, Av. Pedro Venturo No. 313, Santiago de Surco, Lima (PE)

( * ) Notice: Subject to any disclaimer, the term of this patent is extended or adjusted under 35 U.S.C. 154(b) by 0 days.

(21) Appl. No.: 10/165,364

(22) Filed: Jun. 7, 2002

(65) Prior Publication Data

US 2003/0019041 A1 Jan. 30, 2003

(51) Int. Cl.[7] ..... A47C 27/10
(52) U.S. Cl. ..... 5/683; 5/665; 5/671
(58) Field of Search ..... 5/685, 665, 671, 5/682, 683, 686, 687, 678, 674, 676

(56) References Cited

U.S. PATENT DOCUMENTS 1,212,479 A * 1/1917 Hall ..... 5/284
3,999,235 A * 12/1976 Mollura ..... 5/679
4,143,909 A 3/1979 McFarlin ..... 297/284
4,422,194 A * 12/1983 Viesturs et al. ..... 5/686
4,707,872 A * 11/1987 Hessel ..... 5/676
4,738,486 A 4/1988 Surber ..... 297/284
4,907,307 A * 3/1990 Weitzler ..... 5/665
4,929,026 A 5/1990 Barbelet ..... 257/454
5,860,705 A 1/1999 Ridder ..... 297/452.41

* cited by examiner

*Primary Examiner*—Michael Trettel
(74) *Attorney, Agent, or Firm*—Milton Oliver, Esq.; Ware Fressola Van Der Sluys & Adolphson LLP

(57) ABSTRACT

A controlled pressure and floatation system includes support and flotation units, each comprised by two types of chambers: a main one that contains a liquid substance and a secondary empty chamber; interconnected by a free-flow supply pipe. The main chamber receives the body to be held displacing an amount of liquid substance, in proportion to the weight it receives, towards the secondary chamber, that has no contact with the supported body. The pressures and flotation are controlled by the relative height of the secondary chamber (initial and final pressures), its predetermined shape (sequence of pressures until reaching the resting stage); and the density of the liquid substance. Multi-systems to provide different pressures to different parts of the same body may be created with this basic unit or system.

15 Claims, 7 Drawing Sheets

CONTROLLED PRESSURE AND FLOTATION SYSTEM

1. FIELD OF THE INVENTION

This invention relates generally to a support system or unit and particularly to a support system that provides controlled flotation, enabling the overall control of the pressure exercised on the different support points of the supported body.

The purpose of the invention is to provide the supported body a floating or suspended condition, at all times, trying that it does not come into contact with the bottom of the surface on which it is placed or suspended. Due to its characteristics, this invention may be used in leisure furniture industry, such as chairs, sofas and waterbeds as well as for shock resistant fillings, for the transportation of fragile cargo, hospital beds and orthopedics and any other object or product requiring support for its use or improved use.

2. BACKGROUND OF THE INVENTION

To date, several systems developed based on liquid-filled cushions or mattresses have been used in the manufacture of waterbeds and water chairs or sofas in order to improve their support and comfort so that they are able to adapt to the body shape of their occupant as much as possible. However, notwithstanding that the innovations in this field have been very ingenious, up to now all these systems have been based on the same principle: a single body filled with liquid and hermetically sealed ("envelope"; bladder, cushion) that, under the pressure of the weight of its occupant, distributes the liquid inside, adapting it to the shape of the body it holds but that produces the following inconveniences that have not been overcome: i) the little or no control over the pressure of the liquids contained in the cushions or mattresses so that it may correspond proportionally to the pressure exercised by each part of the body; ii) withstanding the waves, in waterbeds particularly, despite the inclusion of sponge-like bodies, springs and other elements inside the mattress; and iii) the tension in the areas of major pressure. Thus, for example, the existing waterbeds evidence an over-stretching or taut sensation in areas such as the head, back, lumbar area, heels, etc. produced by the greater pressure that the body exercises on these areas and which, upon sinking, pulls or stretches the surface, producing certain discomfort. The water chairs and sofas have the added drawback that since they are a single container of a whole, the support pressures that are different for each support area of the supported body cannot be handled or controlled.

As far as we know, this support or suspension system, based on a container full of liquid has not been used in fields other than the furniture industry (beds, chairs, sofas).

The present invention uses a novel system of support units each comprised of two interconnected chambers that enable full control of the pressures on the different support points of the suspended body (human, inanimate, etc.), completely eliminating the wave and over-stretch problems.

3. SUMMARY OF THE INVENTION

This invention is a controlled support and flotation system or unit, comprised by two interconnected chambers: a main chamber that contains a liquid substance and a secondary empty chamber. The main chamber receives the body to be held and upon contact displaces a quantity of liquid substance in proportion to the weight it receives, towards the secondary chamber (that does not come into contact with the supported body), until reaching levels pre-determined by its shape and position. This enables the control of the pressure sequence at the different points of support of the supported body and the flotation offered, trying that the body does not come into contact with the bottom of the surface on which it is deposited or suspended. When the body rises, the displaced liquid substance returns to the main chamber.

4. BRIEF FIGURE DESCRIPTION

FIG. 1 shows the basic system or unit comprised by two chambers—main and secondary, interconnected by a free-flow supply pipe. As observed in the illustration, the chambers may adopt different external shapes: cylindrical, cubic and others.

FIG. 2 shows the free-flow supply pipe and the different shapes and positions that it may adopt in the basic system or unit of two chambers, depending on its design according to its intended use. In the upper section of the illustration, two chambers interconnected by a single supply pipe are shown. In the middle section, two chambers interconnected by two side supply pipes are shown. In the lower section, two secondary chambers are shown, interconnected with the main chamber, each by a single side supply pipe.

5. DETAILED DESCRIPTION

Elements

The "CONTROLLED PRESSURE AND FLOTATION SYSTEM" consists of a unit comprised by the following basic elements:

a) A main chamber, made of waterproof material, flexible, extensible and elastic and of a non-predetermined shape, that may be cylindrical, cubic or any other which cross-section may be circular, square or other.

b) A liquid substance such as water, oil, treated water, gel or any other contained inside the main chamber and the supply pipe.

c) A secondary chamber, made of rigid or flexible material of a shape predetermined according to the control of the basic elements of pressure and flotation; of a slightly larger volume and a greater capacity than the main chamber.

d) A free-flow supply pipe, made of waterproof material, non-collapsible and with an external protection, located between the main and secondary chambers in such a manner so as to interconnect them and allow the free flow of the substance from one to another.

Figure 1:
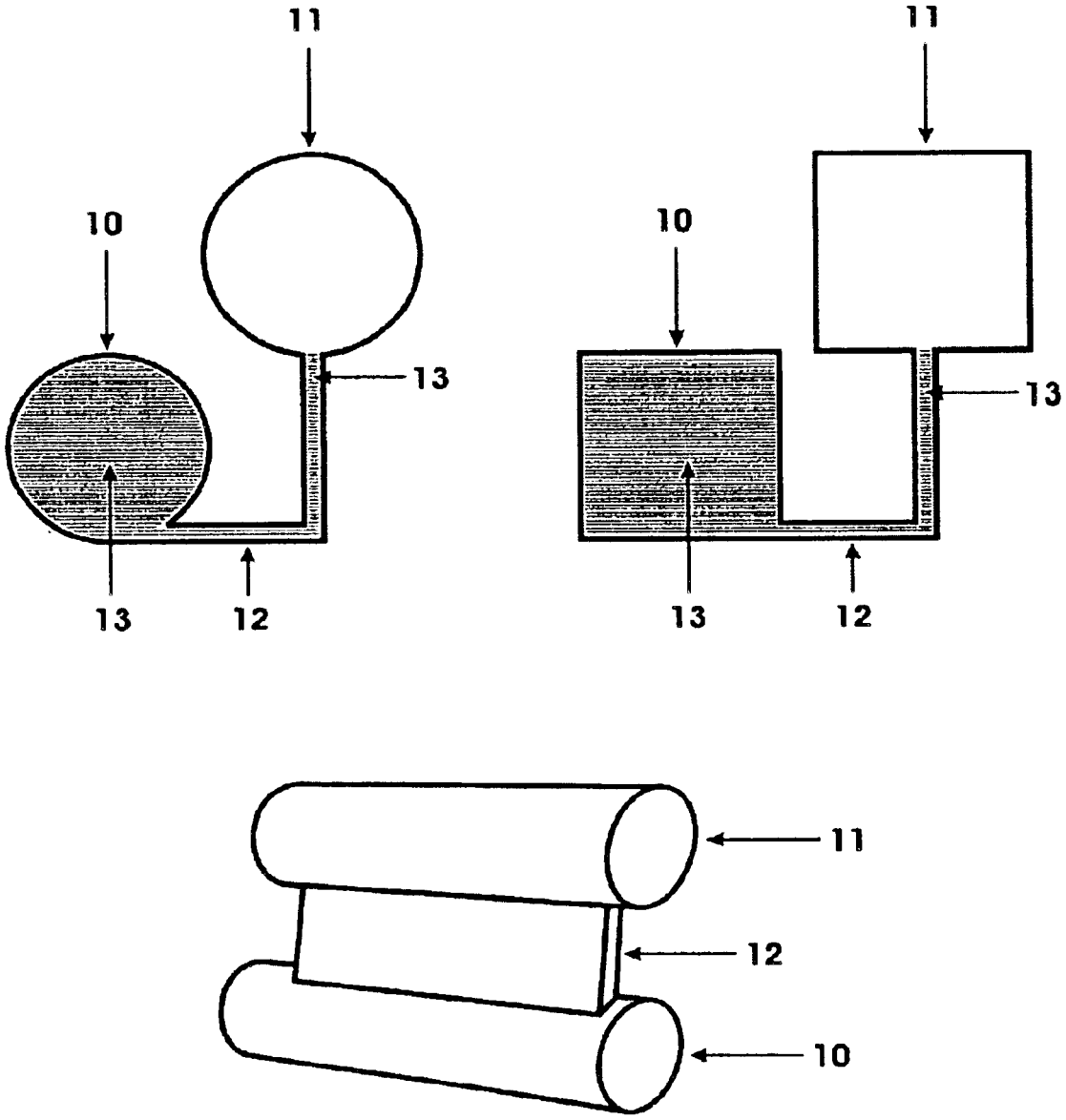
Figure 2:
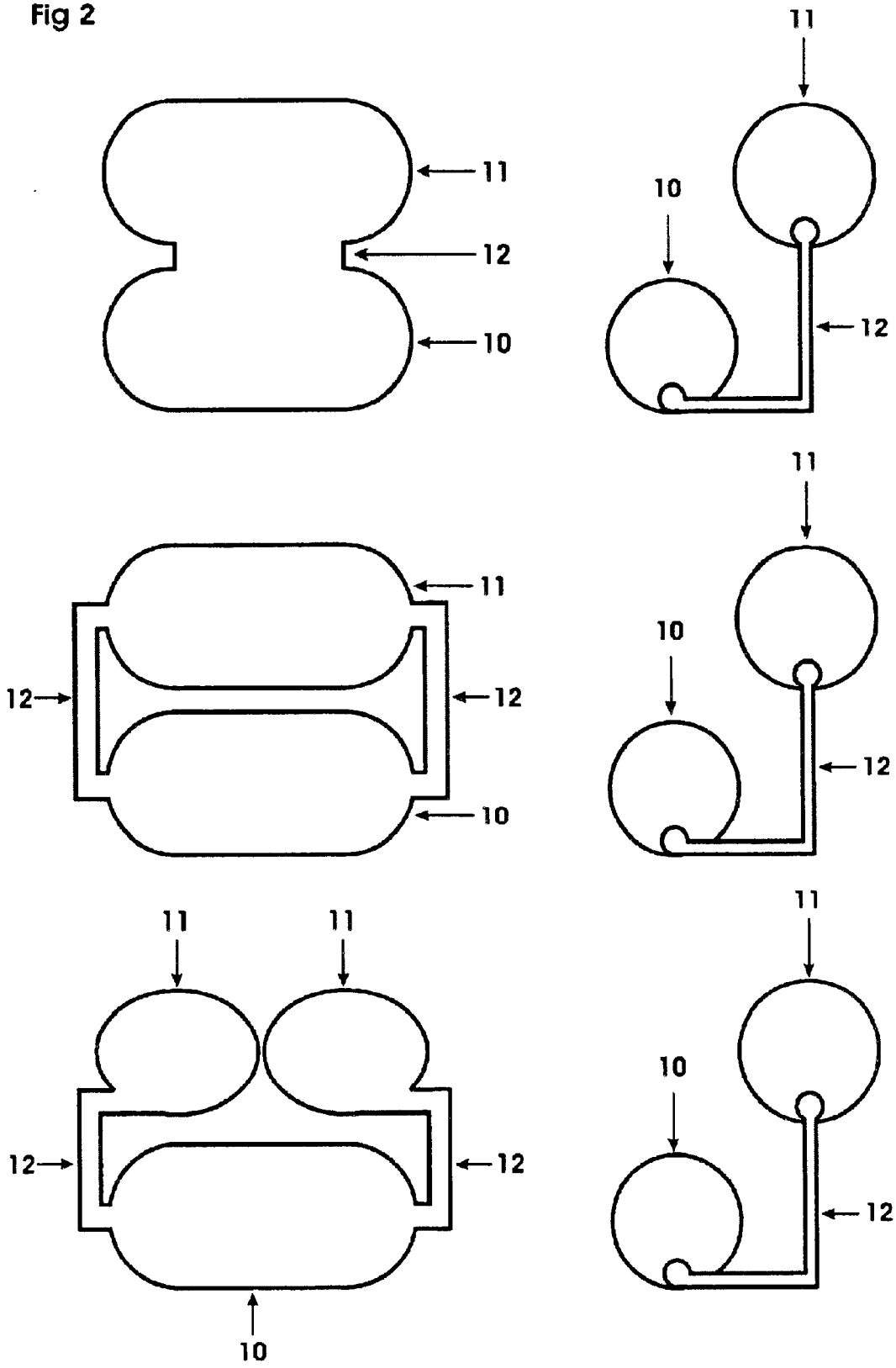

(See FIGS. 1 and 2)

Optionally, this basic unit may contain foam or a soft body with the main chamber. In addition, it may have more than one secondary chamber, depending mainly on its design and the required support features.

Operation

The main chamber—filled with the liquid substance—is the chamber that will receive and withstand the specific body, providing it with an adequate and controlled level of suspension, pressure and flotation so that this body is always properly suspended or floating in the chamber without touching its bottom.

Upon coming into contact with the supported body, the main chamber displaces a quantity of liquid substance in proportion to the weight it receives, towards the secondary chamber, which, in principle, is completely empty.

The secondary chamber, which is never in contact with the suspended body, receives this displacement of liquid released through the free-flow supply pipe, until it reaches levels that have been predetermined by its shape and position, allowing the application of different pressures on the suspended body. As the weight of the body travels towards its final resting position, en-route a sequence of pressures is produced that varies from the initial pressure—from its initial contact with the main chamber—to its final floating position, resting position; the variation in pressure is controlled precisely by the shape and position of the secondary chamber.

When the suspended body rises, the displaced substance returns from the secondary chamber to the main chamber. Since the body, upon rising, exercises maximum pressure, the predetermined shape of the secondary chamber regulates the pressure of the main chamber trying that the supported body does not reach the bottom, providing full flotation and suspension.

In those cases in which the system or unit has foam or a soft body with the main chamber, this contributes to a cushioning effect at the moment of maximum pressure.

The main advantages of this system are:

a) A better pressure distribution (variable, controlled pressure) in the supported areas.

b) Total flotation of the suspended or supported body; and c) Perfect adjustment to the weight, shape and profile of the supported body.

Figure 3:
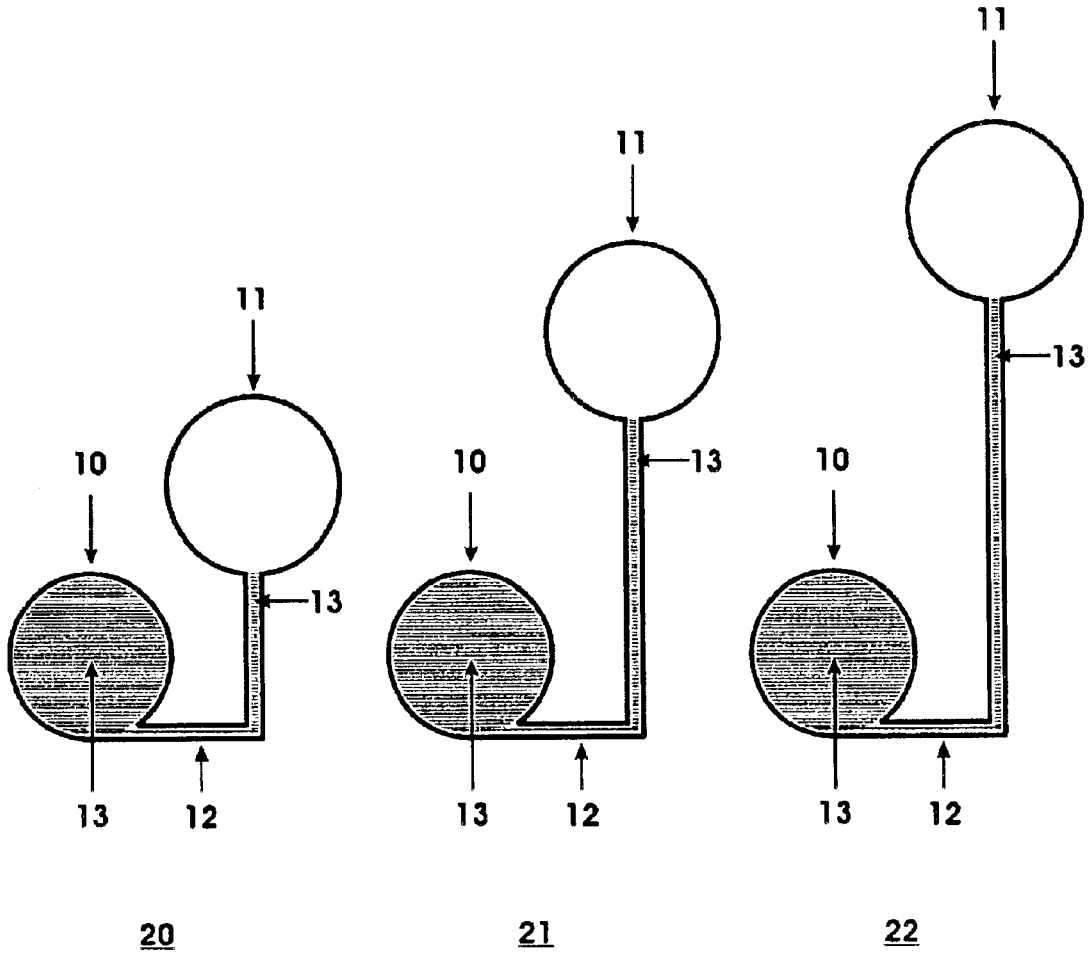
FIG. 3 shows the initial pressure levels provided by the basic two-chamber system or unit based on the relative height of the secondary chamber.
Figure 4:
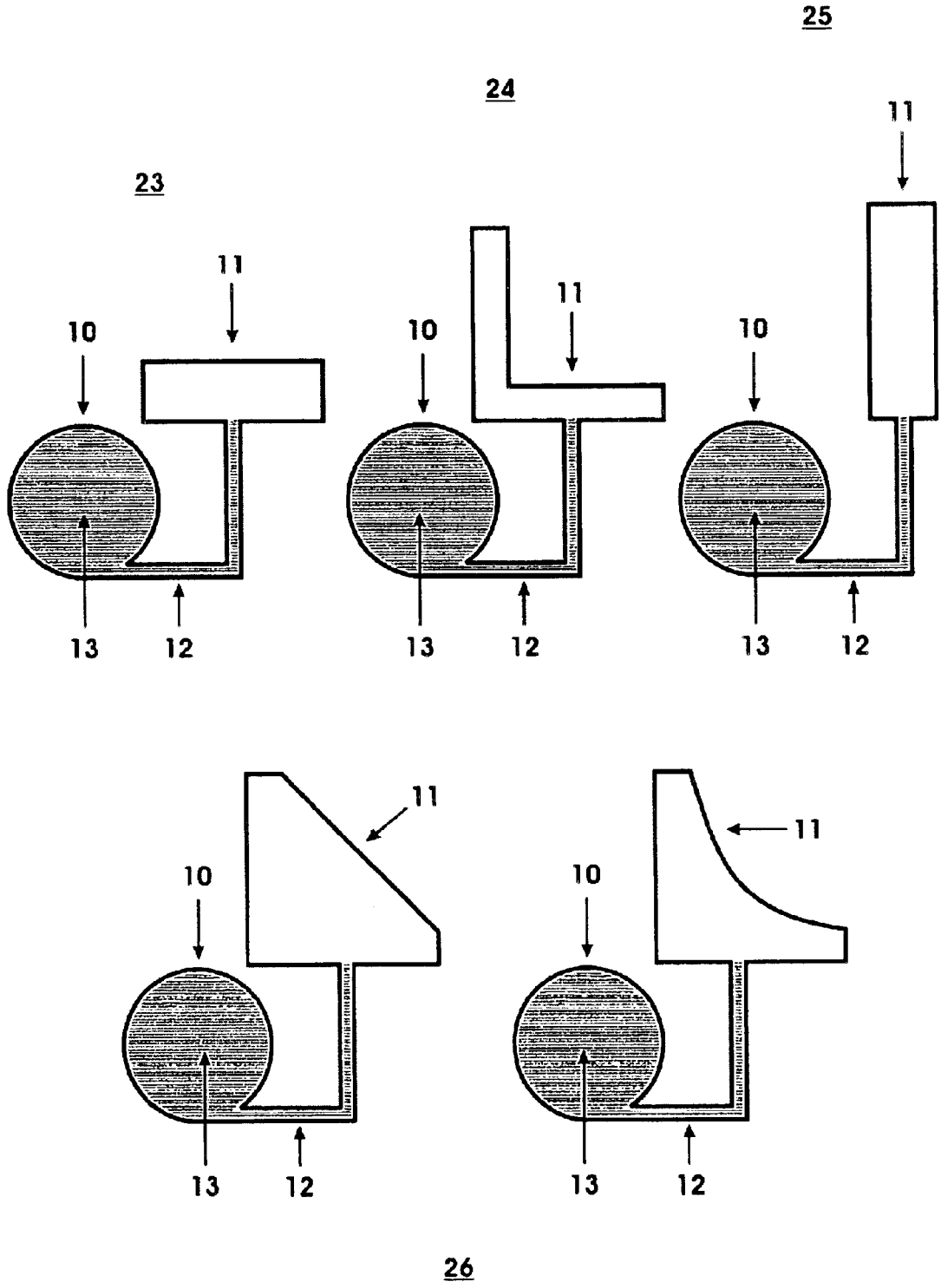
FIG. 4 shows the different shapes that the secondary chamber may adopt according to the type, variation or sequence of flotation and pressure to be provided to the supported body: soft to soft support, support that ranges from soft to firm, firm to form, and others.
Figure 5:
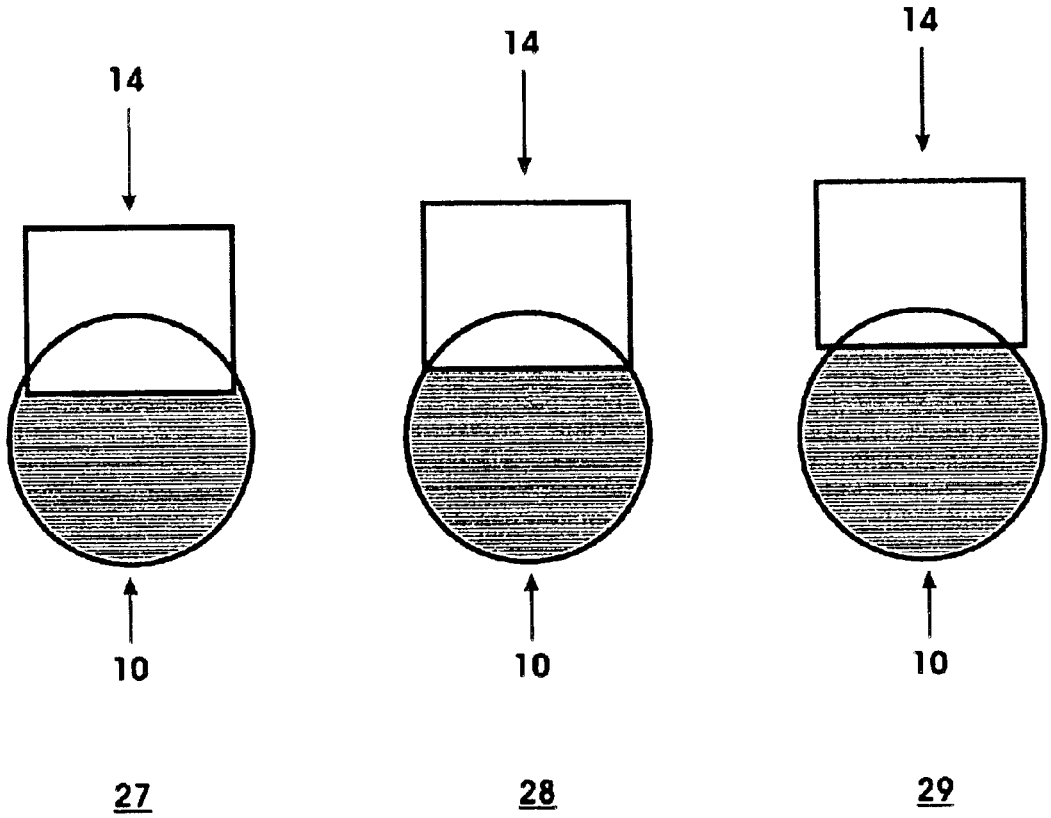
FIG. 5 shows the type of support by the density of the liquid substance contained in the main chamber.

Control Elements:

The pressure or flotation that the main chamber provides to the supported body is basically controlled by the following elements:

a) Relative height of the secondary chamber, the base of which shall never be below the ceiling of the main chamber. The higher the secondary chamber is in relation to the main chamber, the greater the initial pressure (firmer, stronger support) and the lesser the flotation due to the effect of the hydrostatic pressure (see FIG. 3).

b) The shape of the secondary chamber, that determines the sequence of pressures and the flotation to be provided to the suspended body. Thus, for example, if the shape of the cross-section is horizontal a soft to soft or smooth support will be offered; if it is vertical, a firm to firm or hard support; if it is "L" shaped, a support that will go from soft to firm rapidly; if it is trapezoidal, support will gradually go from soft to firm, etc. (See FIG. 4).

c) The density of the liquid substance, contained in the main chamber that influences flotation and the time of reaction to the displacement of the liquid substance towards the secondary chamber (see FIG. 5).

While the two chambers are interconnected, the suspended body only comes into contact with the main chamber, but never with the secondary chamber or the free-flow supply pipe.

Based on the basic system or unit made up of the aforementioned elements, more complex or varied systems—multi-systems can be manufactured or assembled depending on their specific use. In this case, the non-collapsible characteristic of the free-flow supply pipes becomes extremely important since, in a combination of several units, it prevents the obstruction of the conduits as a result of the pressure of other conduits of adjacent units.

Thus, for example, the basic system or unit can be used as a whole, in the construction or manufacture of water chairs or sofas, arranging one or more of these basic units per strategic point of support of the human body so that each part receives support in proportion to its weight and shape, keeping it afloat, even in the most difficult areas such as the lumbar area, neck, leg calves, forearms, etc.

The system may also be used in the manufacture of waterbeds, following the same principle of independent units per points of support. Upon forming the bed's mattress based on individual units, the wave problem and even the taut sensation experienced in conventional waterbeds (in the head, back, hips and buttocks, heel areas), caused by the greater weight of the body in those areas, are completely eliminated. On the other hand, the displacement or rolling of the body supported on conventional waterbeds with the presence of a second body and its movement on the same surface is also eliminated.

Figure 6:
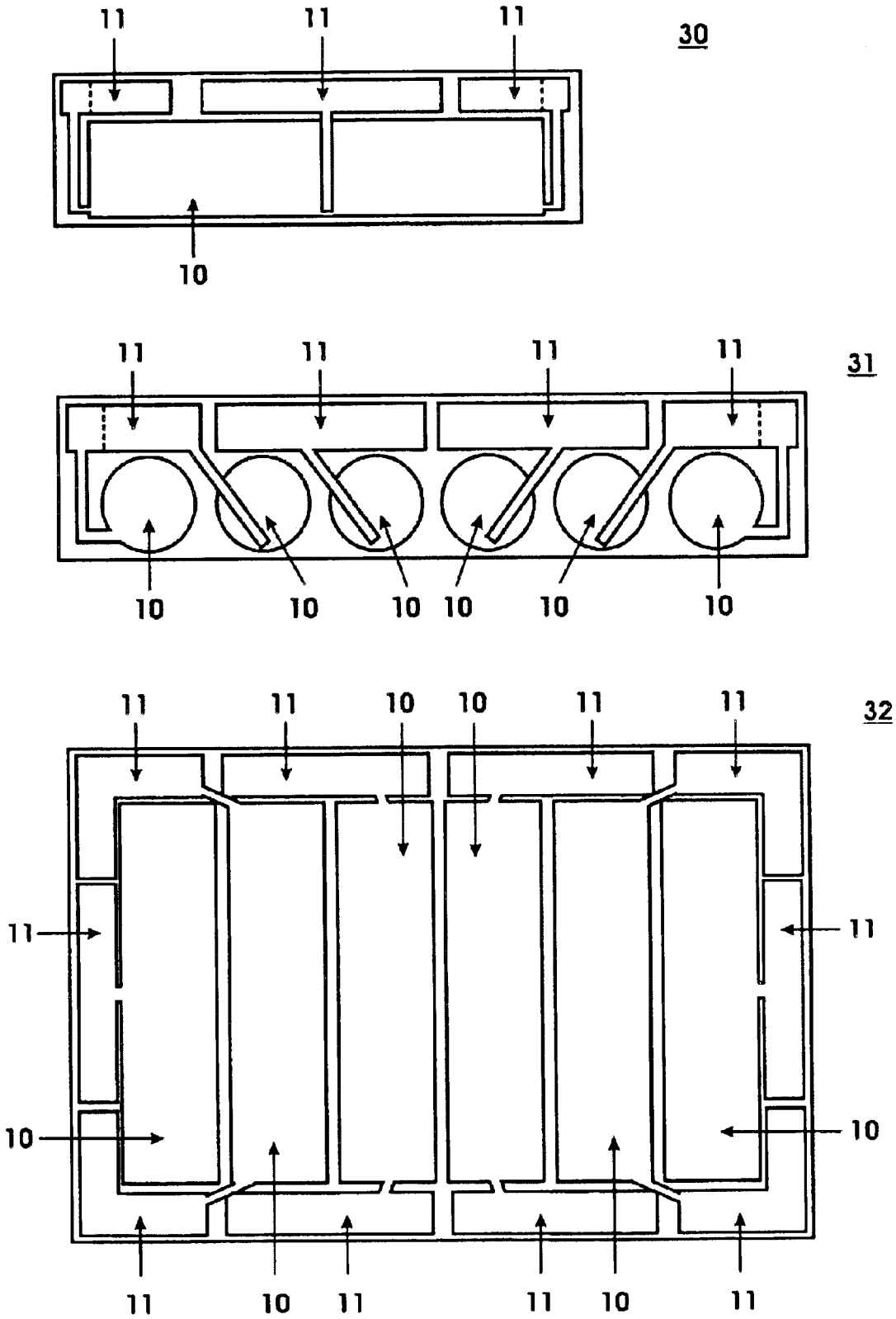
FIG. 6 shows different views of a waterbed manufactured based on the inclusion of the basic controlled pressure and flotation system or unit, in complex units or multi-systems.
Figure 7:
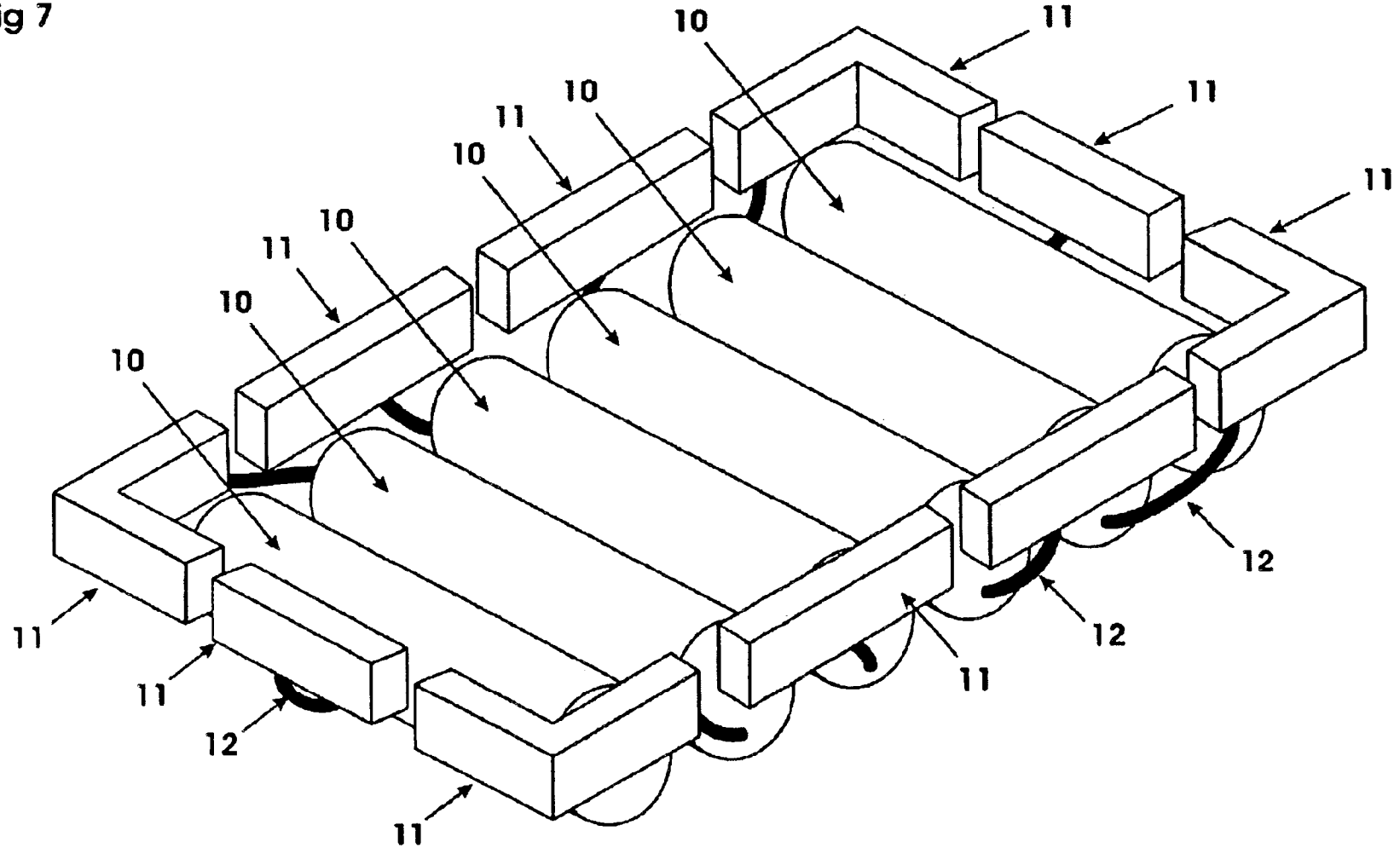
FIG. 7 shows an isometric view of a waterbed that uses the system subject matter of the invention.

This invention may even be used in the manufacture of water pillows due to the its facility to control the desired pressure and flotation (see FIGS. 6 and 7 showing the application of the invention to a bed).

The invention is not only applicable to the leisure furniture industry or the manufacture of packing fillings to transport fragile cargo, where it acts as a shock absorber or minimizer with a variable and controlled pressure; but also in the field of medicine and orthopedics since, due to its characteristics, the controlled pressure and flotation system provides 100% anatomic support, suitable for persons who must remain prostrate (due to problems of locomotion, spine; severe burns, etc.) thereby noticeably reducing the formation of bed sores. The application of the invention in this field (hospital beds, orthopedics) enables the body to rest naturally, in a floating condition that reduces the pressure in the heaviest parts of the body.

Furthermore, this invention in the leisure, health or comfort furniture industry may include additional elements such as electrical or electronic devices for the regulation of temperature, vibration, massage and/or sound, to ensure a pleasant rest.

Various changes and modifications are possible within the scope of the inventive concept. Therefore, the invention is not limited to the particular embodiments shown and described, but rather is defined by the following claims.

What is claimed is:

1. A controlled pressure and flotation system, comprising:

a main chamber formed of a flexible, elastic and impermeable material, adapted to be filled with a liquid and then to be hermetically sealed with respect to an ambient environment, in order to act as a support for any body resting on an external surface of said main chamber;

at least one secondary chamber, arranged higher than said main chamber yet in communication with said main chamber; and a free flow conduit, made of an impermable, flexible and non-collapsible material, providing said communication between the main chamber and the at least one secondary chamber, permitting free flow of liquid from the flexible main chamber, in response to load placed on said main chamber by said body, and from said secondary chamber back to said main chamber, wherein said secondary chamber has a larger volume than does said main chamber.

2. The controlled pressure and flotation system of claim 1, wherein a respective free flow conduit is provided for each secondary chamber.

3. The controlled pressure and flotation system of claim 1, wherein said secondary chamber is adapted to be free of liquid until load is placed on said main chamber and then to receive displaced liquid, said secondary chamber being formed with a shape and height profile corresponding to a desired sequential pattern of firmness or support intended to be provided to said resting body by said main chamber.

4. The controlled pressure and flotation system of claim 3, wherein said secondary chamber has a horizontally elongated transversal section to provide a support pattern going from soft to soft.

5. The controlled pressure and flotation system of claim 3, wherein said secondary chamber has a vertically elongated transversal section to provide a support pattern going from firm to firm.

6. The controlled pressure and flotation system of claim 1, wherein said main chamber is shaped to provide support to the seat and back of a human being.

7. The controlled pressure and flotation system of claim 1, wherein said main chamber is shaped to provide support to a human being resting in a prone orientation.

8. The controlled pressure and flotation system of claim 1, wherein a lowermost portion of said secondary chamber is always higher than an uppermost portion of said main chamber, thereby assuring that any liquid present flows by gravity from said secondary chamber into said main chamber whenever said main chamber is free of loading.

9. The controlled pressure and flotation system of claim 1, further comprising means for reaching and maintaining a predetermined temperature of a liquid inside said system.

10. The controlled pressure and flotation system of claim 1, further comprising means for imparting vibration to liquid inside said system, to thereby massage a human body resting on said main chamber.

11. The controlled pressure and flotation system of claim 1, wherein said main chamber, in an unloaded state, is completely filled with water.

12. The controlled pressure and flotation system of claim 1, wherein said main chamber, in an unloaded state, is completely filled with oil.

13. The controlled pressure and flotation system of claim 1, wherein said main chamber, in an unloaded state, is completely filled with a gel.

14. A controlled pressure and flotation system comprising:

a main chamber formed of a flexible, elastic and impermeable material, adapted to be filled with a liquid and then to be hermetically sealed with respect to an ambient environment, in order to act as a support for any body resting on an external surface of said main chamber;

at least one secondary chamber, arranged higher than said main chamber yet in communication with said main chamber wherein said secondary chamber is adapted to be free of liquid until load is placed on said main chamber and then to receive displaced liquid, said secondary chamber being formed with a shape and height profile corresponding to a desired sequential pattern of firmness or support intended to be provided to said resting body by said main chamber; and a free flow conduit, made of an impermeable, flexible and non-collapsible material, providing said communication between the main chamber and the at least one secondary chamber, permitting free flow of liquid from the flexible main chamber, in response to load placed on said main chamber by said body, and from said secondary chamber back to said main chamber, wherein said secondary chamber has an L-shaped transversal section for a support pattern going quickly from soft to firm.

15. A controlled pressure and flotation system comprising:

a main chamber formed of a flexible, elastic and impermeable material, adapted to be filled with a liquid and then to be hermetically sealed with respect to an ambient environment, in order to act as a support for any body resting on an external surface of said main chamber;

at least one secondary chamber, arranged higher than said main chamber yet in communication with said main chamber wherein said secondary chamber is adapted to be free of liquid until load is placed on said main chamber and then to receive displaced liquid, said secondary chamber being formed with a shape and height profile corresponding to a desired sequential pattern of firmness or support intended to be provided to said resting body by said main chamber; and a free flow conduit, made of an impermeable, flexible and non-collapsible material, providing said communication between the main chamber and the at least one secondary chamber, permitting free flow of liquid from the flexible main chamber, in response to load placed on said main chamber by said body, and from said secondary chamber back to said main chamber, wherein said secondary chamber has a trapezoidal transversal section for a support pattern going gradually from soft to firm.

* * * * *